US011362405B2

(12) United States Patent
Kidera

(10) Patent No.: US 11,362,405 B2
(45) Date of Patent: Jun. 14, 2022

(54) FILTER

(71) Applicant: AGC Inc., Chiyoda-ku (JP)

(72) Inventor: Nobutaka Kidera, Tokyo (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 16/911,459

(22) Filed: Jun. 25, 2020

(65) Prior Publication Data

US 2020/0328489 A1 Oct. 15, 2020

Related U.S. Application Data

(63) Continuation of application No. PCT/JP2019/000228, filed on Jan. 8, 2019.

(30) Foreign Application Priority Data

Jan. 15, 2018 (JP) ..... JP2018-004232

(51) Int. Cl.
*H01P 3/16* (2006.01)
*H01P 1/20* (2006.01)

(52) U.S. Cl.
CPC ..... *H01P 1/2002* (2013.01); *H01P 3/16* (2013.01)

(58) Field of Classification Search
CPC .. H01P 3/122; H01P 3/12; H01P 3/121; H01P 3/16; H01P 1/2002; H01P 1/2088
See application file for complete search history.

(56) References Cited

U.S. PATENT DOCUMENTS

| | | | | |
|---|---|---|---|---|
| 5,330,941 | A | 7/1994 | Yaba et al. | |
| 6,927,653 | B2 * | 8/2005 | Uchimura | H01P 1/2088 333/113 |
| 10,020,591 | B2 | 7/2018 | Uemichi | |
| 2019/0348738 | A1 * | 11/2019 | Kamgaing | H01P 5/12 |

FOREIGN PATENT DOCUMENTS

| | | | |
|---|---|---|---|
| CN | 103515679 | A | 1/2014 |
| EP | 1 067 097 | A1 | 1/2001 |
| EP | 1 302 999 | A1 | 4/2003 |
| EP | 3 618 174 | A1 | 3/2020 |
| JP | 07-330357 | A | 12/1995 |
| JP | 2000-239031 | A | 9/2000 |
| JP | 2004-099376 | A | 4/2004 |
| JP | 2005-020415 | A | 1/2005 |

(Continued)

OTHER PUBLICATIONS

Williams et al., "Direct Determination of Water in Glass", Ceramic Bulletin, vol. 55, No. 5, 1976, 2 pages.

(Continued)

*Primary Examiner* — Stephen E. Jones
(74) *Attorney, Agent, or Firm* — Oblon, McClelland, Maier & Neustadt, L.L.P.

(57) ABSTRACT

A filter includes a waveguide formed in a dielectric surrounded by a conductor wall. The conductor wall includes at least one control wall protruding toward an inner side of the waveguide. The at least one control wall includes an end portion in a protruding direction of the at least one control wall and a central portion in the protruding direction. The end portion includes a wall portion of which wall thickness is different from the central portion.

20 Claims, 19 Drawing Sheets

(56) References Cited

FOREIGN PATENT DOCUMENTS

| | | | |
|---|---|---|---|
| JP | 2014-023028 | A | 2/2014 |
| JP | 2015-207969 | A | 11/2015 |
| JP | 6312910 | B1 | 4/2018 |

OTHER PUBLICATIONS

Kato et al., "Permittivity measurements and associated uncertainties up to 110GHz in circular-disk resonator method", Proceedings of the 46$^{th}$ European Microwave Conference, Oct. 4-6, 2016, 4 pages.

* cited by examiner

FILTER

CROSS-REFERENCE TO RELATED APPLICATION

The present application is a continuation application filed under 35 U.S.C. 111 (a) claiming benefit under 35 U.S.C. 120 and 365 (c) of PCT International Application No. PCT/JP2019/000228 filed on Jan. 8, 2019 and designating the U.S., which claims priority to Japanese Patent Application No. 2018-004232 filed on Jan. 15, 2018. The entire contents of the foregoing applications are incorporated herein by reference.

BACKGROUND OF THE INVENTION

1. Field of the Invention

The present invention relates to a filter.

2. Description of the Related Art

Conventionally, a filter having an SIW (Substrate Integrated Waveguide) structure in which multiple control walls are formed at predetermined intervals inside a waveguide formed in a dielectric layer sandwiched between a first conductor layer and a second conductor layer is known (for example, see PTL 1). There is also a filter in which multiple slits are arranged at predetermined intervals on a pair of side surfaces of a dielectric waveguide (for example, see FIG. 16 of PTL 2).

CITATION LIST

Patent Literatures

PTL 1: Japanese Laid-Open Patent Publication No. 2015-207969

PTL 2: Japanese Laid-Open Patent Publication No. 2005-020415

SUMMARY OF THE INVENTION

Technical Problem

In the field of waveguide filters as described above, an efficient design method for achieving desired filter characteristics has not been found, and it has been difficult to adjust the filter characteristics to desired filter characteristics. However, the inventor of the present application has found that the filter characteristics can be adjusted to desired filter characteristics more easily by adjusting the wall thickness at the end of the control wall than by adjusting the wall thickness at the base of the control wall.

Accordingly, the present disclosure provides a filter of which filter characteristic can be easily adjusted to a desired filter characteristic.

Means for Solving the Problems

According to an aspect of the present disclosure, a filter includes a waveguide formed in a dielectric surrounded by a conductor wall. The conductor wall includes at least one control wall protruding toward an inner side of the waveguide. The at least one control wall includes an end portion in a protruding direction of the at least one control wall and a central portion in includes a wall portion of which wall thickness is different from the central portion.

Advantageous Effects of Invention

According to a filter of the present disclosure, the filter characteristic can be easily adjusted to a desired filter characteristic.

DETAILED DESCRIPTION OF THE PREFERRED EMBODIMENTS

Hereinafter, an embodiment for carrying out the present invention will be described with reference to the drawings. An X-axis direction, a Y-axis direction, and a Z-axis direction represent a direction parallel to the X axis, a direction parallel to the Y axis, and a direction parallel to the Z axis, respectively. The X-axis direction, the Y-axis direction, and the Z-axis direction are orthogonal to each other. An XY plane, a YZ plane, and a ZX plane are an imaginary plane parallel to the X axis direction and the Y axis direction, an imaginary plane parallel to the Y axis direction and the Z axis direction, and an imaginary plane parallel to the Z axis direction and the X axis direction, respectively.

The filter according to the present disclosure is a waveguide filter that has a waveguide formed in a dielectric surrounded by conductor walls, and is configured to filter radio frequency signals in the high-frequency band (for example, 0.3 GHz to 300 GHz) such as microwaves and millimeter waves. The filter according to the present disclosure is suitable for filtering radio frequency signals corresponding to electromagnetic waves transmitted or received by antennas of the 5th generation mobile communication system (i.e., 5G) or vehicle-mounted radar systems.

Figure 1:
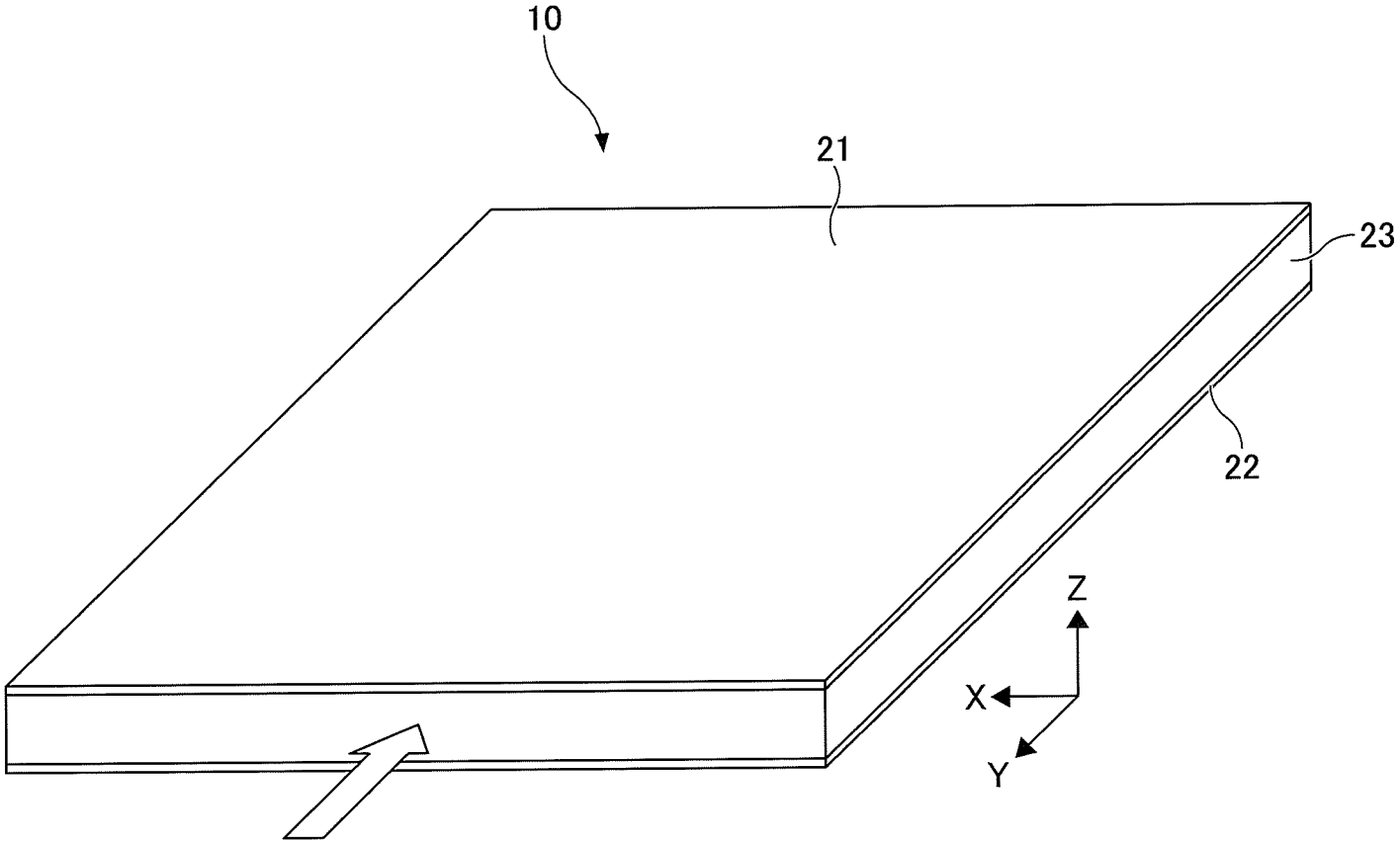
FIG. 1 is a perspective view illustrating an example of configuration of a filter according to the present disclosure.

FIG. 1 is a perspective view illustrating an example of configuration of a filter according to the present disclosure. The filter according to the present disclosure 10 illustrated in FIG. 1 is a band-pass filter having an SIW structure formed by a first conductor layer 21, a second conductor layer 22, and a dielectric 23 sandwiched between the first conductor layer 21 and the second conductor layer 22. The filter 10 passes radio frequency signals of a predetermined frequency band passing in the Y axis direction, and blocks the radio frequency signals of the frequency bands other than the predetermined frequency band.

The first conductor layer 21 and the second conductor layer 22 are flat conductors arranged parallel to the XY plane and oppose each other in the Z axis direction. The first conductor layer 21 and the second conductor layer 22 are formed in a rectangular shape having its longitudinal direction extending in the Y axis direction. Examples of materials for the first conductor layer 21 and the second conductor layer 22 include silver, copper, and the like.

The dielectric 23 is formed in a cuboid shape having its longitudinal direction extending in the Y axis direction. Although not clearly illustrated in FIG. 1, conductor walls are formed on a pair of side surfaces opposing each other in the X axis direction of the dielectric 23, i.e., a pair of interfaces located inside the dielectric 23 and opposing each other in the X axis direction, so that a waveguide is formed in the dielectric 23. Examples of materials for the dielectric 23 include glass such as silica glass, ceramics, fluorine-based resin such as polytetrafluoroethylene, liquid crystal polymer, cycloolefin polymer, and the like. Moreover, the dielectric 23 is not limited to a solid and may be a gas such as air.

Figure 2:
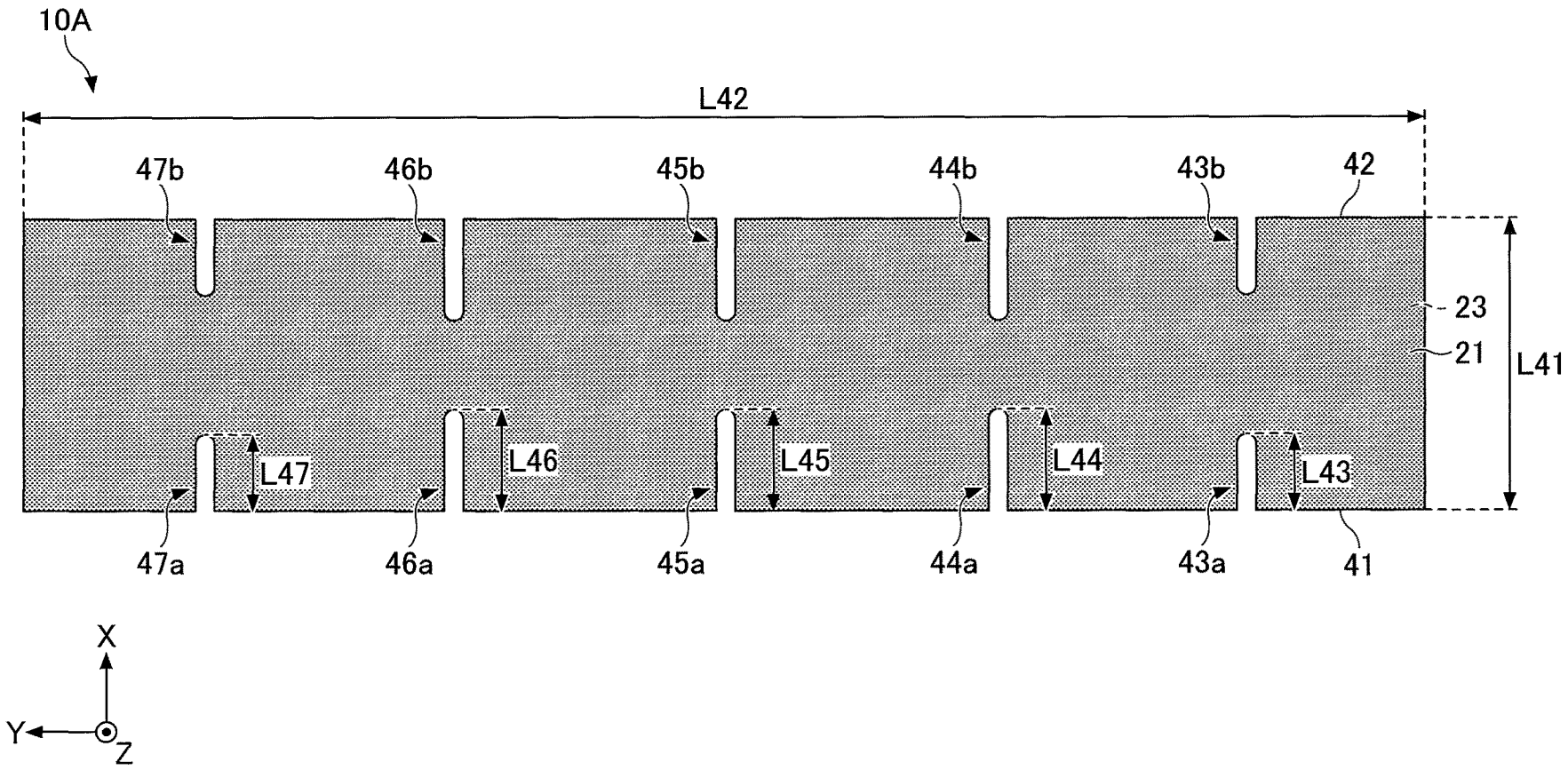
FIG. 2 is a plan view illustrating a filter of a first embodiment according to the present disclosure.

FIG. 2 is a plan view illustrating a filter of a first embodiment according to the present disclosure. The filter 10A illustrated in FIG. 2 is an example of the filter 10 of FIG. 1, and has a waveguide formed in the dielectric 23 surrounded by the conductor walls. The conductor walls surrounding the dielectric 23 include an upper side conductor wall corresponding to the first conductor layer 21, a lower side conductor wall corresponding to the second conductor layer 22, and a pair of side surface conductor walls 41, 42 formed on a pair of side surfaces opposing each other in the X axis direction of the dielectric 23.

A dielectric portion surrounded by the pair of side surface conductor walls 41, 42, the upper side conductor wall, and the lower side conductor wall functions as a waveguide extending in the Y axis direction so as to guide electromagnetic waves in the Y axis direction.

Each of the pair of side surface conductor walls 41, 42 includes, on the inside of the waveguide, multiple control walls protruding in the X axis direction. The filter 10A of the first embodiment includes control walls 43*a* to 47*a* protruding from the first side surface conductor wall 41 toward the second side surface conductor wall 42 and control walls 43*b* to 47*b* protruding from the second side surface conductor wall 42 toward the first side surface conductor wall 41. Each of these control walls is formed by a conductor slit of which the surface is covered with a conductor. Each conductor slit has an upper end connected to the upper side conductor wall and a lower end connected to the lower side conductor wall, and corresponds to a portion obtained by coating, with a conductor, the surface of the slit produced by, e.g., cutting the dielectric 23.

These control walls are formed, for example, to be orthogonal to the upper side conductor wall and the lower side conductor wall parallel to the XY plane and to be orthogonal to the pair of side surface conductor walls 41, 42 parallel to the YZ plane (i.e., the control walls are formed to be parallel to the ZX plane). For example, the control walls 43*a* to 47*a* are formed so that adjacent control walls are spaced apart by equal intervals in the Y axis direction, and protrude from the first side surface conductor wall 41 toward the second side surface conductor wall 42. Likewise, for example, the control walls 43*b* to 47*b* are formed so that adjacent control walls are spaced apart by equal intervals in the Y axis direction, and protrude from the second side surface conductor wall 42 toward the first side surface conductor wall 41. More specifically, the X axis direction illustrated in FIG. 2 represents the protruding direction of each of the control walls 43*a* to 47*a*, 43*b* to 47*b*.

For example, each of the pair of control walls 43*a*, 43*b*, the pair of control walls 44*a*, 44*b*, the pair of control walls 45*a*, 45*b*, the pair of control walls 46*a*, 46*b*, and the pair of control walls 47*a*, 47*b* is formed in a same ZX plane. The positions of the control walls in each pair may be offset from each other in the Y axis direction.

Lengths L43 to L47 represent lengths in the X axis direction of the control walls 43*a* to 47*a*, respectively. The control walls 43*a* to 47*a* are set to such lengths that each of the control walls 43*a* to 47*a* serves as a wall for the electromagnetic waves propagating in the waveguide, and the control walls 43*a* to 47*a* function as post walls reflecting the electromagnetic waves propagating in the waveguide. The control walls 43*b* to 47*b* are preferably set to lengths similar to the above.

Where a wavelength (guide wavelength) of electromagnetic waves propagating in the waveguide is denoted as $\lambda g$, an interval L41 between the pair of side surface conductor walls 41, 42 is preferably about the same as $\lambda g/2$. Where the wavelength (guide wavelength) of electromagnetic waves propagating in the waveguide is denoted as $\lambda g$, an interval between control walls adjacent to each other in the Y axis direction is preferably about the same as $\lambda g/2$.

The control walls 43*a* to 47*a* are arranged to be spaced apart by the interval in the Y axis direction, and the lengths in the X axis direction of the control walls 43*a* to 47*a* may be gradually increased or gradually decreased in the order of arrangement in the Y axis direction of the control walls 43*a* to 47*a*. In this case, the degree of suppressing the reflection loss of electromagnetic waves propagating in the waveguide can be adjusted with high accuracy. For example, the lengths L47, L46, L45 are gradually increased in this order, and the lengths L44, L43 are gradually decreased in this order. Likewise, the lengths in the X axis direction of the control walls 43*b* to 47*b* arranged to be spaced apart by the interval in the Y axis direction may be gradually increased or gradually decreased in the order of arrangement in the Y axis direction of the control walls 43*b* to 47*b*, so that the degree of suppressing the reflection loss of electromagnetic waves propagating in the waveguide can be adjusted with high accuracy. It should be noted that the lengths in the X axis direction of the control walls may be set to the same length as each other.

In the control walls 43*a* to 47*a*, 43*b* to 47*b*, the pairs of control walls opposing each other in the X axis direction and the pairs of control walls adjacent to each other in the Y axis direction constitute multiple resonators, each having a length of about $\lambda g/2$, arranged in the Y axis direction (where the wavelength (guide wavelength) of electromagnetic waves propagating in the waveguide is denoted as $\lambda g$). The coupling between these resonators is adjusted by the length in the X axis direction and the width in the Y axis direction (i.e., wall thickness) of each control wall, and affects the reflection characteristic and the frequency characteristic as the filter. In this manner, the filter 10A is a band-pass filter having multiple resonators (i.e., four resonators in the case of FIG. 2) formed between adjacent control walls in the Y axis direction.

Figure 3:
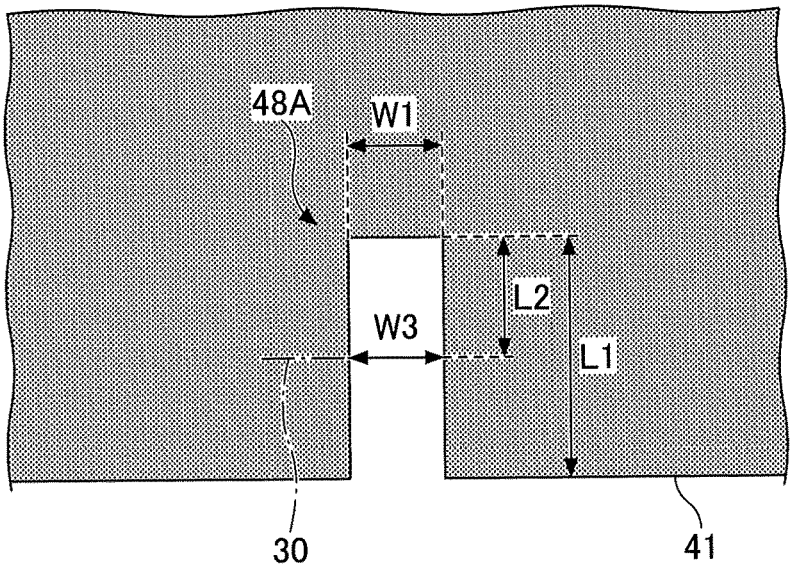
FIG. 3 is a plan view illustrating an example of formation (comparative example) of a control wall formed with a slit.

FIG. 3 is a plan view illustrating a shape of a control wall 48A which is a comparative example of the control wall according to the first embodiment. The control wall 48A includes a rectangular slit shape. Therefore, a wall thickness W1 at the end portion of the control wall 48A is the same as a wall thickness W3 at the central portion of the control wall 48A.

In contrast, the end portions of control walls 48B to 48E illustrated in FIGS. 4 to 7, respectively, have wall portions of which the wall thicknesses are different from the wall thicknesses at the central portions of the control walls. Each of the control walls 48B to 48E is an example of the control walls 43*a* to 47*a*, 43*b* to 47*b* according to the first embodiment.

The control wall 48B has an end portion in which a tip protruding in the X axis direction is rounded, and the end portion of the control wall 48B has a wall portion having a wall thickness W1 that is smaller than a wall thickness W3 at the central portion of the control wall 48B. Specifically, the end portion of the control wall 48B has a first wall portion and a second wall portion having wall thicknesses different from each other. The first wall portion is a semi-circular portion including an arch-shaped tip and has a portion having the wall thickness W1. The second wall portion is a straight line portion located between the first wall portion and the central portion of the control wall 48B, and has the wall thickness W3 that is larger than the wall thickness W1.

The control wall 48C has a wedge-shaped end portion, and the end portion of the control wall 48C includes a wall portion having a wall thickness W1 that is smaller than a wall thickness W3 at the central portion of the control wall 48C. Specifically, the end portion of the control wall 48C has a first wall portion and a second wall portion having wall thicknesses different from each other. The first wall portion is a triangular portion including a tip with an acute angle, and has a portion having the wall thickness W1. The second wall portion is a straight line portion located between the first wall portion and the central portion of the control wall 48C, and has the wall thickness W3 that is larger than the wall thickness W1.

The control wall 48D has an end portion in which a tip protruding in the X axis direction is narrowed in a rectangular shape, and the end portion of the control wall 48D has a wall portion having a wall thickness W1 that is smaller than a wall thickness W3 at the central portion of the control wall 48D. Specifically, the end portion of the control wall 48D has a first wall portion and a second wall portion having wall thicknesses different from each other. The first wall portion is a straight line portion including a rectangular tip and has the wall thickness W1. The second wall portion is a straight line portion located between the first wall portion and the central portion of the control wall 48D, and has the wall thickness W3 that is larger than the wall thickness W1.

The control wall 48E has an end portion in which a tip protruding in the X axis direction is widened in a rectangular shape, and the end portion of the control wall 48E has a wall portion having a wall thickness W1 that is larger than a wall thickness W3 at the central portion of the control wall 48E. Specifically, the end portion of the control wall 48E has a first wall portion and a second wall portion having wall thicknesses different from each other. The first wall portion is a straight line portion including a tip in a rectangular shape and has the wall thickness W1. The second wall portion is a straight line portion located between the first wall portion and the central portion of the control wall 48E, and has the wall thickness W3 that is smaller than the wall thickness W1.

In this manner, the end portions of the control walls 48B to 48E illustrated in FIGS. 4 to 7, respectively, have wall portions having wall thicknesses different from the wall thicknesses at the central portions of the control walls. With reference to the control wall 48A of FIG. 3 in which the wall thicknesses at the end portion, the central portion, and the base portion are the same, the filter characteristic can be adjusted to a desired filter characteristic more easily when the wall thicknesses are different between the end portion and the central portion as in FIGS. 4 to 7 than when the wall thicknesses are different between the base portion and the central portion. This is because since the electric field is most concentrated in the central part of the waveguide, it is considered that the electric field distribution is more easily be changed by changing the wall thickness of the end portion located in proximity to this central part of the waveguide. In other words, the electric field distribution tends to change more greatly and the filter characteristic can be adjusted to a desired filter characteristic more easily in a case where the wall thickness is adjusted at the end portion of the control wall than in a case where the wall thickness is adjusted at the base portion of the control wall that is relatively far from the central part of the waveguide. As a result, the degree of flexibility in designing the filter characteristic of the filter 10A is improved as compared with the case where the wall thickness is adjusted at the base portion of the control wall.

Figure 4:
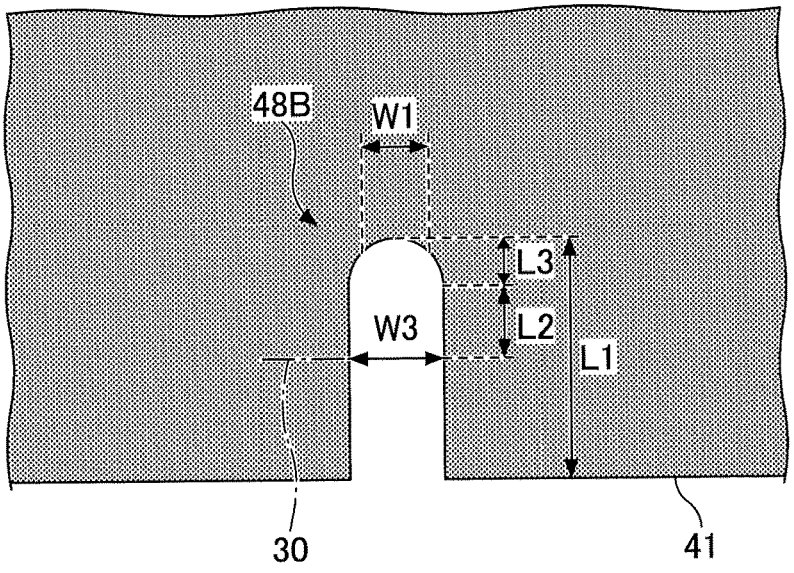
FIG. 4 is a plan view illustrating an example of formation of a control wall formed with a slit.
Figure 5:
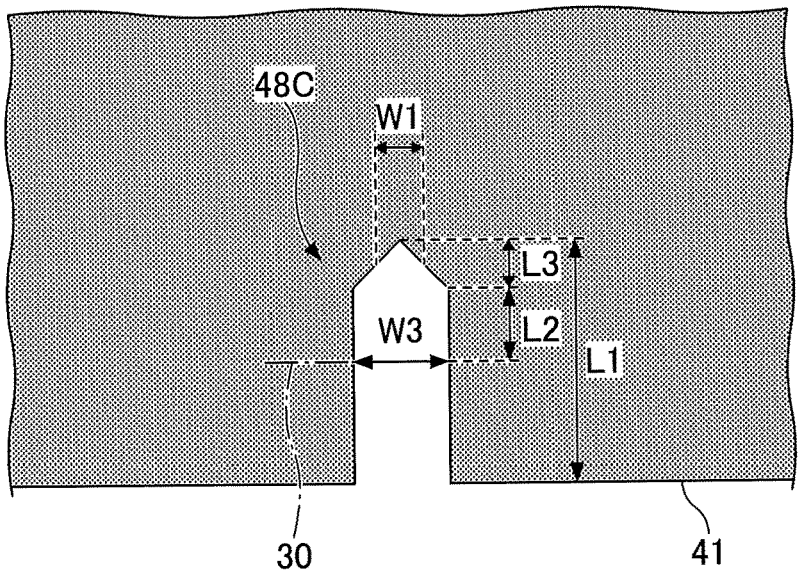
FIG. 5 is a plan view illustrating an example of formation of a control wall formed with a slit.
Figure 6:
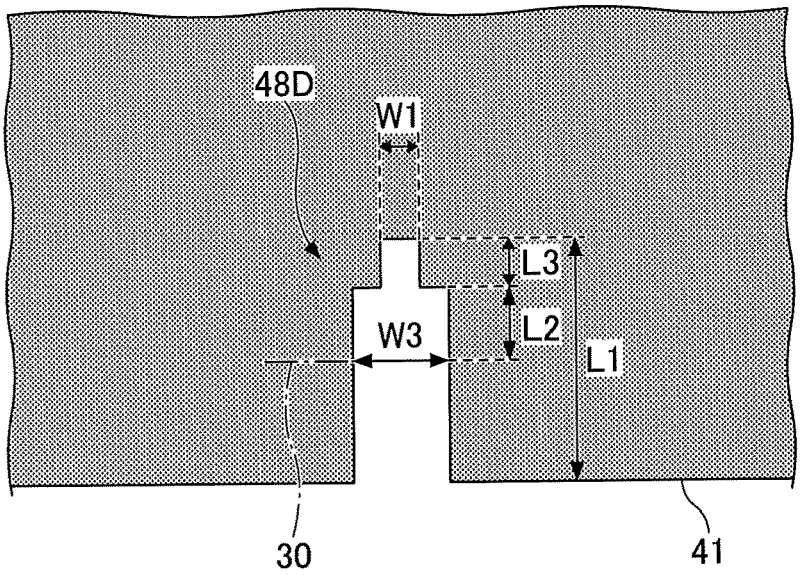
FIG. 6 is a plan view illustrating an example of formation of a control wall formed with a slit.
Figure 7:
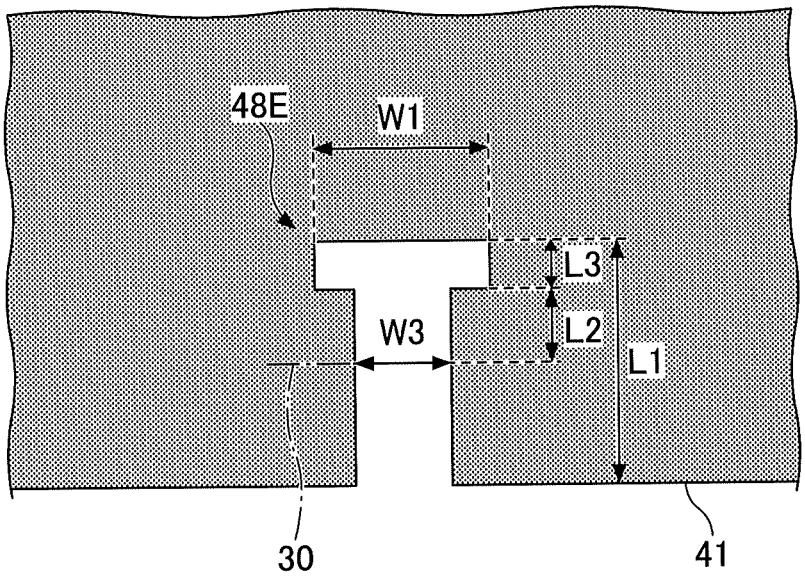
FIG. 7 is a plan view illustrating an example of formation of a control wall formed with a slit.

For example, the bandwidth of the transfer characteristic of the filter 10A (i.e., the frequency band in which radio frequency signals can pass through the filter 10A) can be widened in a case where the wall thickness at the end portion is smaller than the wall thickness at the central portion as in FIGS. 4 to 6 than in a case where the wall thickness at the end portion is the same as the wall thickness at the central portion as in FIG. 3. Conversely, the bandwidth of the transfer characteristic of the filter 10A (i.e., the frequency band in which radio frequency signals can pass through the filter 10A) can be narrowed in a case where the wall thickness at the end portion is larger than the wall thickness at the central portion as in FIG. 7 than in a case where the wall thickness at the end portion is the same as the wall thickness at the central portion as in FIG. 3.

In addition, the inventor of the present application has found that the filter characteristic can be easily adjusted to a desired filter characteristic even when the length L3 in the X axis direction of the first wall portion is shorter than the length L2 in the X axis direction of the second wall portion. Further, the inventor of the present application has found that the filter characteristic can be easily adjusted to a desired filter characteristic even when L3/(L2+L3) is less than 0.2.

It should be noted that the central portion of the control wall represents a portion through which a center line 30, which bisects the length L1 of the control wall in the protruding direction, passes. The end portion of the control wall represents a portion between the tip and the central portion of the control wall of the control wall in the protruding direction. The base portion of the control wall represents a portion from which the control wall protrudes from the conductor wall. The length L1 represents the length in the X axis direction of the control wall. The length L2 represents the length in the X axis direction of the second wall portion. The length L3 represents the length in the X axis direction of the first wall portion. The boundary between the first wall portion and the second wall portion corresponds to the location where the wall thickness changes.

Figure 8:
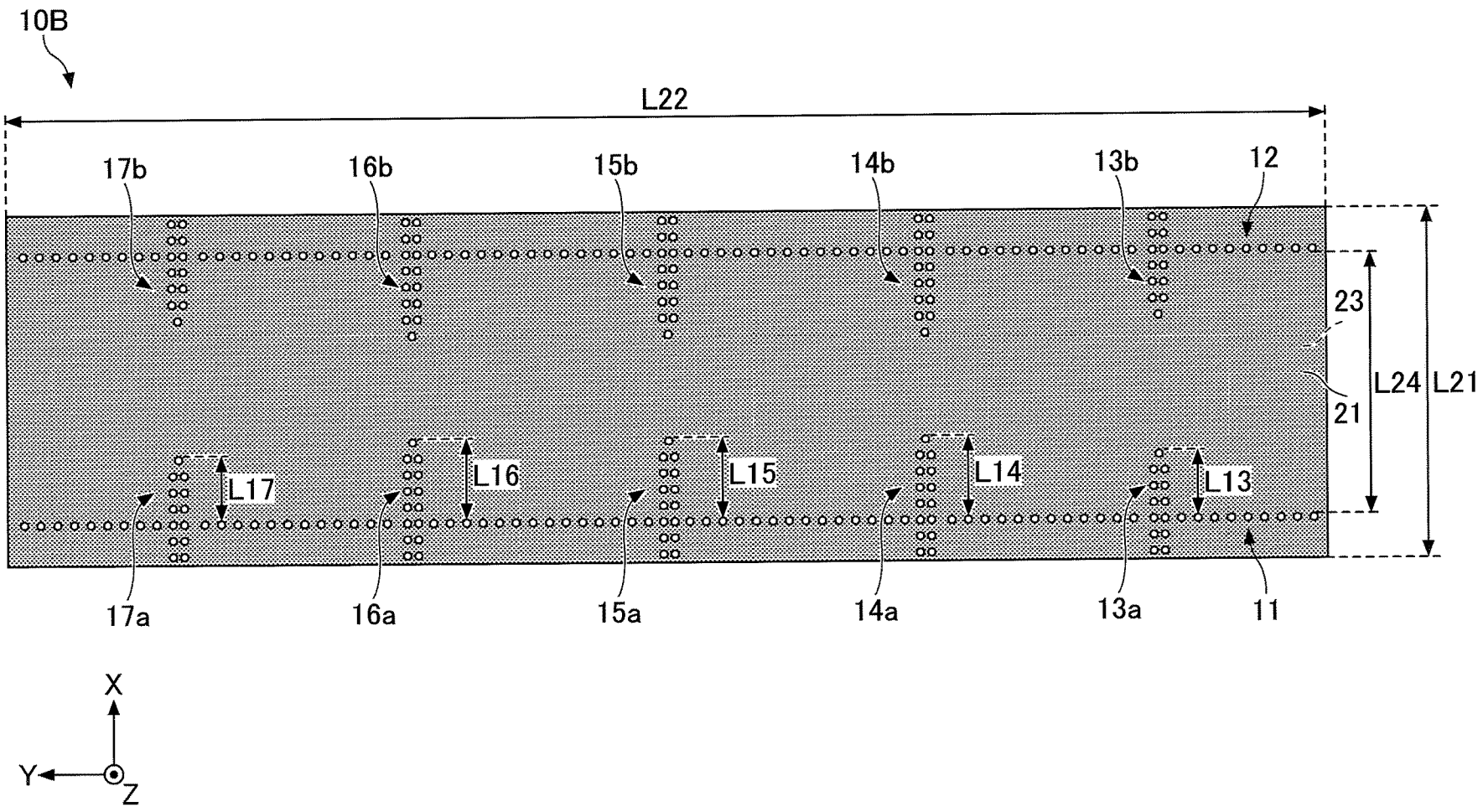
FIG. 8 is a plan view illustrating a filter of a second embodiment according to the present disclosure.

FIG. 8 is a plan view illustrating a filter of the second embodiment according to the present disclosure. The filter 10B illustrated in FIG. 8 is an example of the filter 10 of FIG. 1, and has a waveguide formed in the dielectric 23 surrounded by the conductor walls. In the second embodiment, the description of the same configurations and effects as those of the first embodiment are omitted by referring to the above description.

In the second embodiment, the conductor walls surrounding the dielectric 23 include an upper side conductor wall corresponding to the first conductor layer 21, a lower side conductor wall corresponding to the second conductor layer 22, and a pair of post walls 11, 12 formed on a pair of interfaces opposing in the X axis direction of the dielectric 23.

The dielectric portion surrounded by the pair of post walls 11, 12, the upper side conductor wall, and the lower side conductor wall functions as a waveguide extending in the Y axis direction so as to guide electromagnetic waves in the Y axis direction.

Each of the post walls 11, 12 is a set of multiple conductor posts arranged like a fence. Each conductor post is a columnar conductor that has an upper end connected to the upper side conductor wall and a lower end connected to the lower side conductor wall. For example, the post walls 11, 12 are made of conductor plating formed on the hole wall surfaces of the through holes penetrating the dielectric 23 in the Z axis direction.

The pair of post walls 11, 12 has multiple control walls protruding toward the inner side of the waveguide in the X axis direction. The filter 10B according to the second embodiment includes: control walls 13*a* to 17*a* protruding from the first post wall 11 toward the second post wall 12; and control walls 13*b* to 17*b* protruding from the second post wall 12 toward the first post wall 11. Each of these conductor walls is a set of multiple conductor posts arranged like a fence. Each conductor post is a columnar conductor that has an upper end connected to the upper side conductor wall and a lower end connected to the lower side conductor wall. For example, these conductor walls are made of conductor plating formed on the hole wall surfaces of the through holes penetrating the dielectric 23 in the Z axis direction. Each of the control walls may be formed by multiple conductor posts arranged in multiple rows (e.g., two rows in FIG. 8), or may be formed by multiple conductor posts arranged in one row.

Lengths L13 to L17 represent the lengths in the X axis direction of the control walls 13*a* to 17*a*, respectively. The conductor posts of the control walls 13*a* to 17*a* are arranged with intervals sufficiently shorter than the wavelength of electromagnetic waves propagating in the waveguide. The intervals between the conductor posts of the control walls 13*a* to 17*a* and the conductor posts of the first post wall 11 are also set to intervals sufficiently shorter than the wavelength of the electromagnetic waves propagating in the waveguide. The control walls 13*a* to 17*a* are set to such lengths that each of the control walls 13*a* to 17*a* serves as a wall for the electromagnetic waves propagating in the waveguide, and the control walls 13*a* to 17*a* function as post walls reflecting the electromagnetic waves propagating in the waveguide. The control walls 13*b* to 17*b* are preferably set to lengths similar to the above.

Where the wavelength (guide wavelength) of electromagnetic waves propagating in the waveguide is denoted as $\lambda g$, a length L24 between the pair of post walls 11, 12 is preferably about the same as $\lambda g/2$. Where the wavelength (guide wavelength) of electromagnetic waves propagating in the waveguide is denoted as $\lambda g$, an interval between control walls adjacent to each other in the Y axis direction is preferably about the same as $\lambda g/2$.

In this manner, the filter 10B is a band-pass filter having multiple resonators (e.g., four resonators in the case of FIG. 2) formed between conductor walls adjacent to each other in the Y axis direction.

Figure 9:
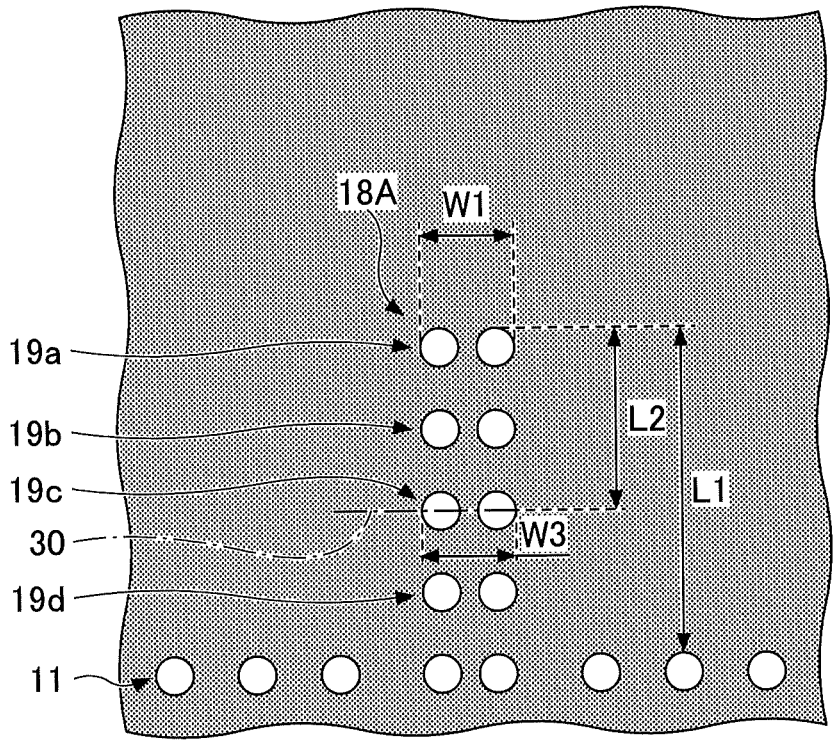
FIG. 9 is a plan view illustrating an example of formation (comparative example) of a control wall formed by multiple conductor posts.
Figure 10:
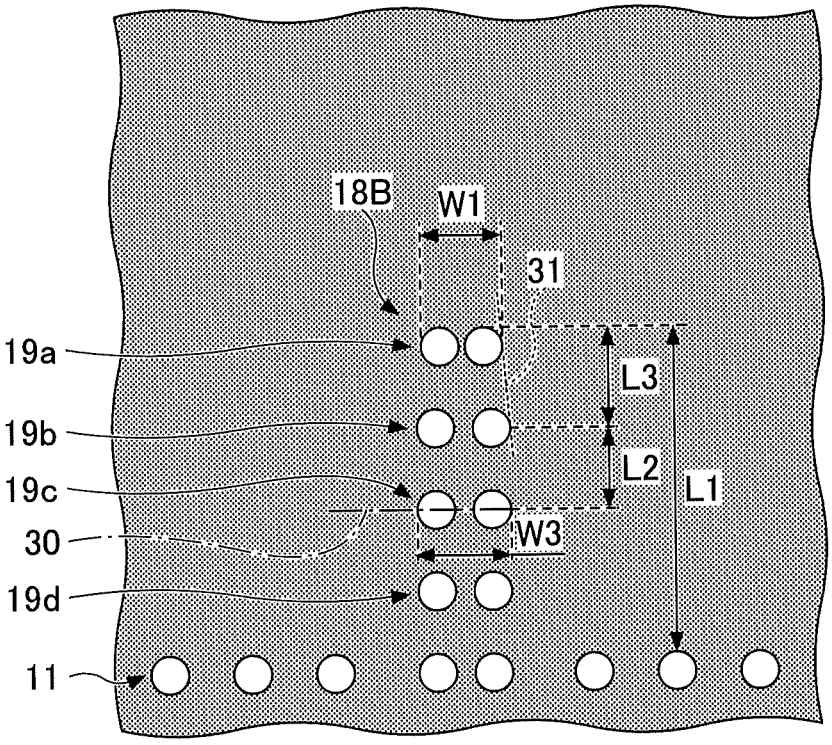
FIG. 10 is a plan view illustrating an example of formation of a control wall formed by multiple conductor posts.
Figure 11:
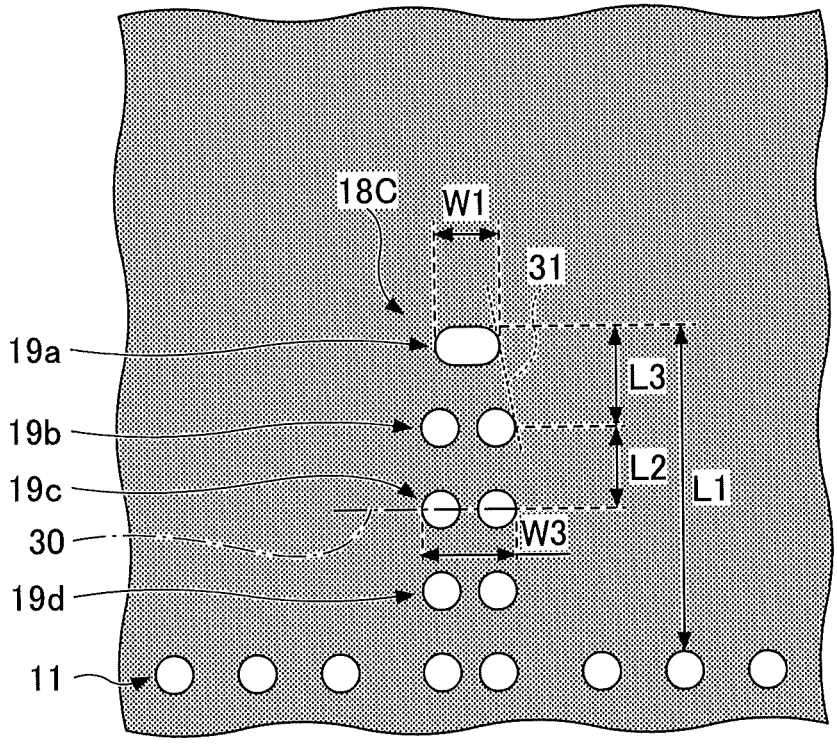
FIG. 11 is a plan view illustrating an example of formation of a control wall formed by multiple conductor posts.
Figure 12:
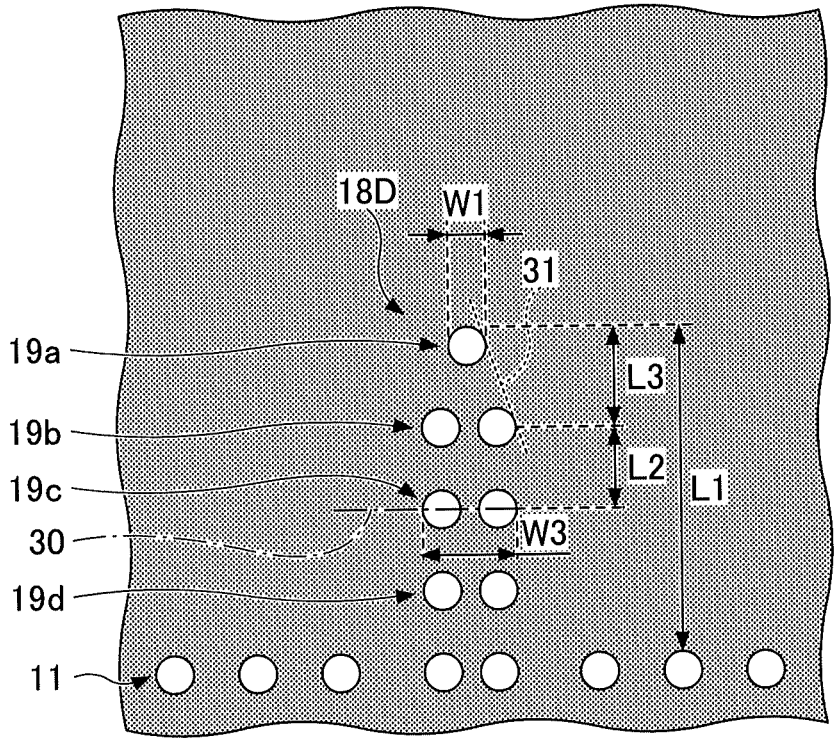
FIG. 12 is a plan view illustrating an example of formation of a control wall formed by multiple conductor posts.
Figure 13:
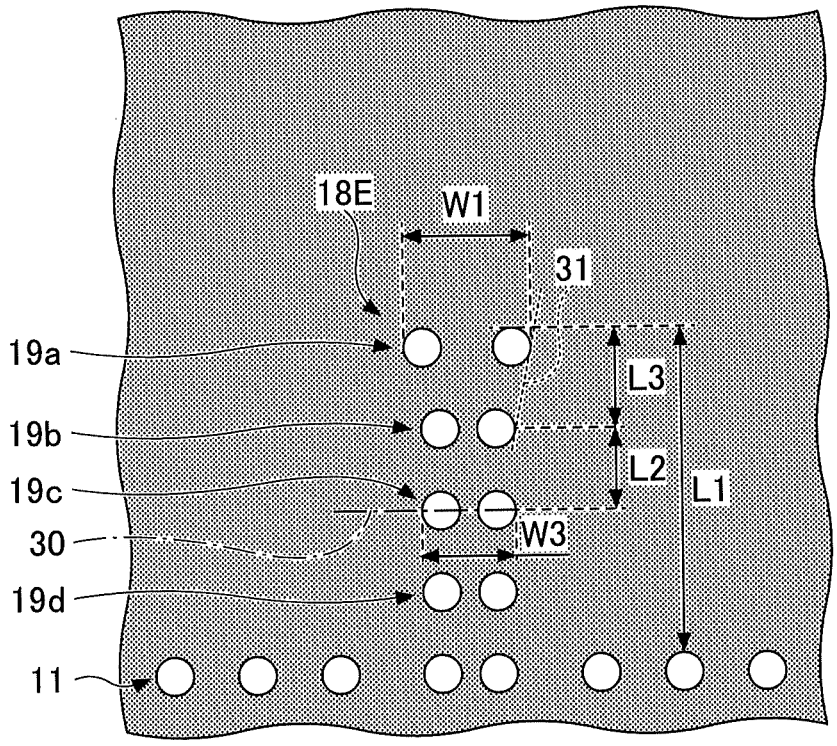
FIG. 13 is a plan view illustrating an example of formation of a control wall formed by multiple conductor posts.
Figure 14:
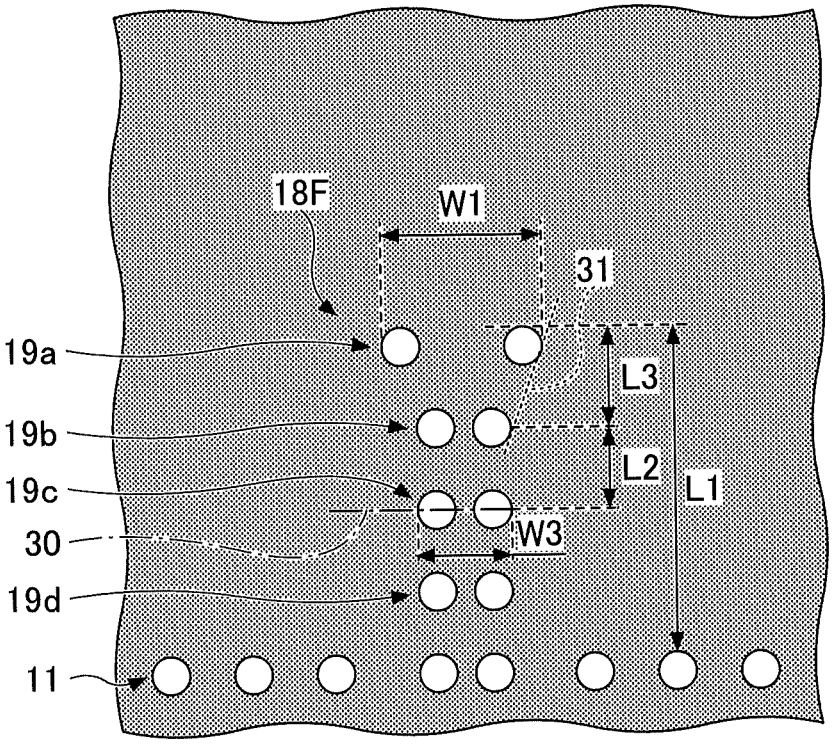
FIG. 14 is a plan view illustrating an example of formation of a control wall formed by multiple conductor posts.
Figure 15:
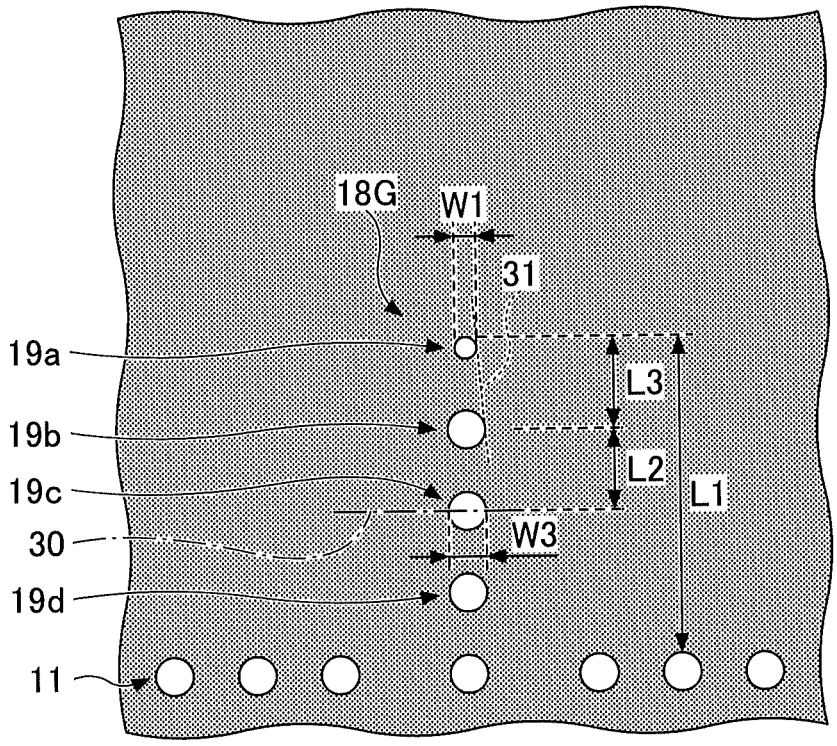
FIG. 15 is a plan view illustrating an example of formation of a control wall formed by multiple conductor posts.
Figure 16:
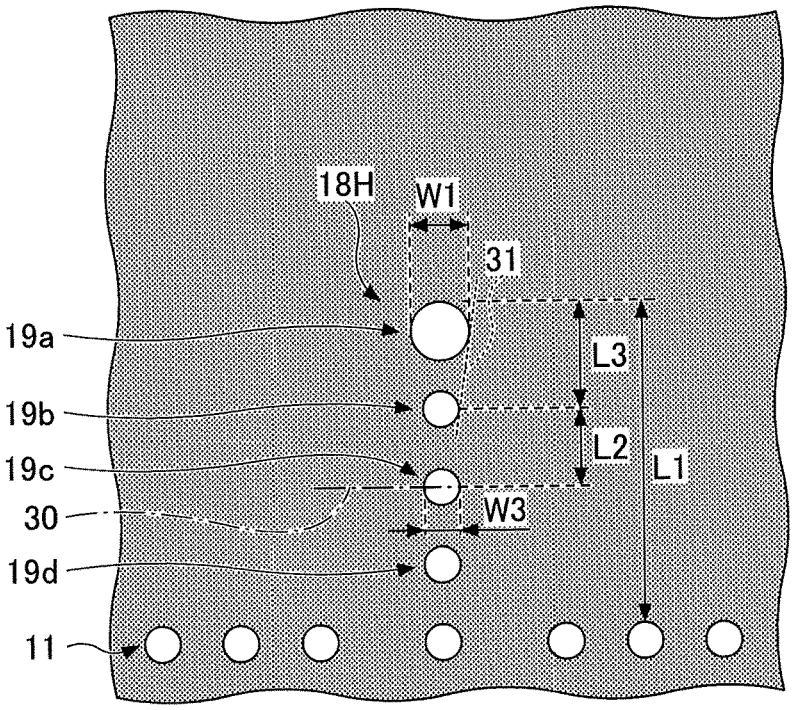
FIG. 16 is a plan view illustrating an example of formation of a control wall formed by multiple conductor posts.

FIG. 9 is a plan view illustrating a shape of a control wall 18A which is a comparative example of a control wall according to the second embodiment. The control wall 18A has a rectangular post shape. Therefore, a wall thickness W1 at the end portion of the control wall 18A is the same as a wall thickness W3 at the central portion of the control wall 18A.

In contrast, the end portions of the control walls 18B to 18H illustrated in FIGS. 10 to 16, respectively, have wall portions of which the wall thicknesses are different from the central portions of the control walls. Each of the control walls 18B to 18H is an example of the control walls 13*a* to 17*a*, 13*b* to 17*b* according to the second embodiment.

The control wall 18B has an end portion of which the wall thickness formed by two conductor posts 19*a* forming the tip protruding in the X axis direction is narrower than the wall thickness formed by two conductor posts 19*c* forming the central portion. In other words, the end portion has a wall portion having a wall thickness W1 smaller than a wall thickness W3 at the central portion of the control wall 18B. Specifically, the end portion of the control wall 18B has a first wall portion and a second wall portion having wall thicknesses different from each other. The first wall portion is a portion formed by: the two conductor posts 19*a* arranged at a position farthest from the base portion in the X axis direction of the control wall 18B; and the two conductor posts 19*b* arranged at a position second farthest from the base portion in the X axis direction of the control wall 18B. The first wall portion includes a portion having the wall thickness W1. The second wall portion is a straight line portion located between the first wall portion and the central portion of the control wall 18B, and has a portion having the wall thickness W3 larger than the wall thickness W1. The wall thickness W1 formed by the two conductor posts 19*a* arranged at the position farthest from the base portion is smaller than the wall thickness formed by the two conductor posts 19*d* arranged at the position closest to the base portion.

The control wall 18C includes an end portion in which a wall thickness formed by a single conductor post 19*a* in a shape of a slotted hole forming a tip protruding in the X axis direction is narrowed with respect to the wall thickness formed by two conductor posts 19*c* forming the central portion. In other words, the end portion has a wall portion having a wall thickness W1 smaller than a wall thickness W3 at the central portion of the control wall 18C. Specifically, the end portion of the control wall 18C has a first wall portion and a second wall portion having wall thicknesses different from each other. The first wall portion is a portion formed by: the single conductor post 19*a* arranged at a position farthest from the base portion in the X axis direction of the control wall 18C; and the two conductor posts 19*b* arranged at a position second farthest from the base portion in the X axis direction of the control wall 18C. The first wall portion has a portion having the wall thickness W1. The second wall portion is a straight line portion located between the first wall portion and the central portion of the control wall 18C, and has a portion having the wall thickness W3 larger than the wall thickness W1. The wall thickness W1 formed by the single conductor post 19*a* arranged at the position farthest from the base portion is smaller than the wall thickness formed by the two conductor posts 19*d* arranged at the position closest to the base portion.

The control wall 18D includes an end portion in which a wall thickness formed by a single conductor post 19*a* in a shape of a perfect circle forming a tip protruding in the X axis direction is narrowed with respect to the wall thickness formed by two conductor posts 19*c* forming the central portion. In other words, the end portion has a wall portion having a wall thickness W1 smaller than a wall thickness W3 at the central portion of the control wall 18D. Specifically, the end portion of the control wall 18D has a first wall portion and a second wall portion having wall thicknesses different from each other. The first wall portion is a portion formed by: the single conductor post 19*a* arranged at a position farthest from the base portion in the X axis direction of the control wall 18D; and the two conductor posts 19*b* arranged at a position second farthest from the base portion in the X axis direction of the control wall 18D. The first wall portion has a portion having the wall thickness W1. The second wall portion is a straight line portion located between the first wall portion and the central portion of the control wall 18D, and includes a portion having the wall thickness W3 larger than the wall thickness W1. The wall thickness W1 formed by the single conductor post 19*a* arranged at the position farthest from the base portion is smaller than the wall thickness formed by the two conductor posts 19*d* arranged at the position closest to the base portion.

The control wall 18E includes an end portion in which a wall thickness formed by two conductor posts 19*a* forming a tip protruding in the X axis direction is widened with respect to the wall thickness formed by two conductor posts 19*c* forming the central portion. In other words, the end portion has a wall portion having a wall thickness W1 larger than a wall thickness W3 at the central portion of the control wall 18E. Specifically, the end portion of the control wall 18E has a first wall portion and a second wall portion having wall thicknesses different from each other. The first wall portion is a portion formed by: the two conductor posts 19*a* arranged at a position farthest from the base portion in the X axis direction of the control wall 18E; and the two conductor posts 19*b* arranged at a position second farthest from the base portion in the X axis direction of the control wall 18E. The first wall portion has a portion having the wall thickness W1. The second wall portion is a straight line portion located between the first wall portion and the central portion of the control wall 18E, and has a portion having the wall thickness W3 smaller than the wall thickness W1. The wall thickness W1 formed by the two conductor posts 19*a* arranged at the position farthest from the base portion is larger than the wall thickness formed by the two conductor posts 19*d* arranged at the position closest to the base portion.

The control wall 18F has a structure similar to the control wall 18E, except that the wall thickness W1 of the first wall portion is larger than that of the control wall 18E.

The control wall 18G includes an end portion in which a wall thickness formed by a single conductor post 19*a* forming a tip protruding in the X axis direction is narrowed with respect to the wall thickness formed by the single conductor post 19*c* forming the central portion. In other words, the end portion has a wall portion having a wall thickness W1 smaller than a wall thickness W3 at the central portion of the control wall 18G. Specifically, the end portion of the control wall 18G has a first wall portion and a second wall portion having wall thicknesses different from each other. The first wall portion is a portion formed by: the single conductor post 19*a* arranged at a position farthest from the base portion in the X axis direction of the control wall 18G; and the single conductor post 19*b* arranged at a position second farthest from the base portion in the X axis direction of the control wall 18G. For example, the first wall portion has a portion having the wall thickness W1 corresponding to the diameter of the single conductor post 19*a*. The second wall portion is a straight line portion located between the first wall portion and the central portion of the control wall 18G, and has a portion having the wall thickness W3 larger than the wall thickness W1. For example, the second wall portion has a portion having the wall thickness W3 corresponding to the diameter of the single conductor post 19*c*. The diameter of the single conductor post 19*a* arranged at the position farthest from the base portion is smaller than the diameter of the single conductor post 19*d* arranged at a position closest to the base portion. Therefore, the wall thickness formed by the single conductor post 19*a* is smaller than the wall thickness formed by the single conductor post 19*d*.

The control wall 18H has a configuration similar to the control wall 18G, except that the control wall 18H has an end portion of which the wall thickness formed by a single conductor post 19*a* forming the tip protruding in the X axis direction is widened with respect to the wall thickness formed by a single conductor post 19*c* forming the central portion. The diameter of the single conductor post 19*a* arranged at a position farthest from the base portion is larger than the diameter of the single conductor post 19*d* arranged at a position closest to the base portion. Therefore, the wall thickness formed by the single conductor post 19*a* is larger than the wall thickness formed by the single conductor post 19*d*.

Therefore, the end portions of the control walls 18B to 18H illustrated in FIGS. 10 to 16, respectively, have wall portions of which wall thicknesses are different from the central portions of the control walls. With reference to to the control wall 18A illustrated in FIG. 9 in which the wall thicknesses at the end portion, the central portion, and the base portion are the same, the filter characteristics can be adjusted to desired filter characteristics more easily when the wall thicknesses are changed between the end portion and the central portion as in FIGS. 10 to 16 than when the wall thicknesses are changed between the base portion and the central portion. The reason for this is similar to the reason described in the first embodiment. Therefore, the degree of flexibility in designing the filter characteristic of the filter 10B is improved as compared with the case where the wall thickness is adjusted at the base portion of the control wall.

For example, the bandwidth of the transfer characteristic of the filter 10B (i.e., the frequency band in which radio frequency signals can pass through the filter 10B) can be widened in a case where the wall thickness at the end portion is smaller than the wall thickness at the central portion as in FIGS. 10 to 12, 15 than in a case where the wall thickness at the end portion is the same as the wall thickness at the central portion as in FIG. 9. Conversely, the bandwidth of the transfer characteristic of the filter 10B (i.e., the frequency band in which radio frequency signals can pass through the filter 10B) can be narrowed in a case where the wall thickness at the end portion is larger than the wall thickness at the central portion as in FIGS. 13, 14, 16 than in a case where the wall thickness at the end portion is the same as the wall thickness at the central portion as in FIG. 9.

Figure 17:
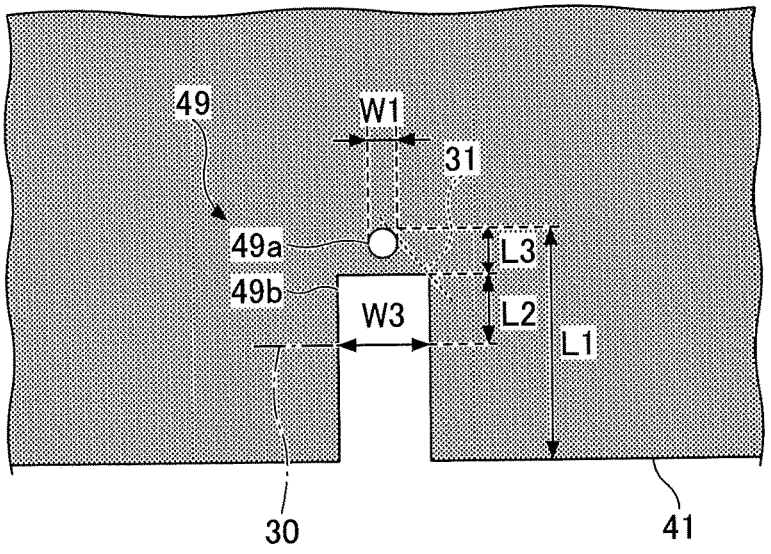
FIG. 17 is a plan view illustrating an example of formation of a control wall formed by a slit and a conductor post.

In the filter according to the present disclosure, each control wall may be formed by at least one conductor slit and at least one conductor post. For example, the control wall 49 illustrated in FIG. 17 is formed by one conductor slit 49*b* having a wall thickness W3 and a single conductor post 49*a* having a wall thickness W1 smaller than the wall thickness W3. In FIG. 17, the wall thickness W1 may be configured to be larger than the wall thickness W3. Like the case described above, the filter characteristics can be adjusted to desired filter characteristics more easily when the wall thicknesses are changed between the end portion and the central portion as in FIG. 17 than when the wall thicknesses are changed between the base portion and the central portion.

It should be noted that a tangent 31 is an imaginary straight line for defining a boundary (i.e., a portion where the wall thickness changes) between the first wall portion and the second wall portion. The tangent 31 represents a tangent of the first wall portion and the second wall portion.

Figure 18:
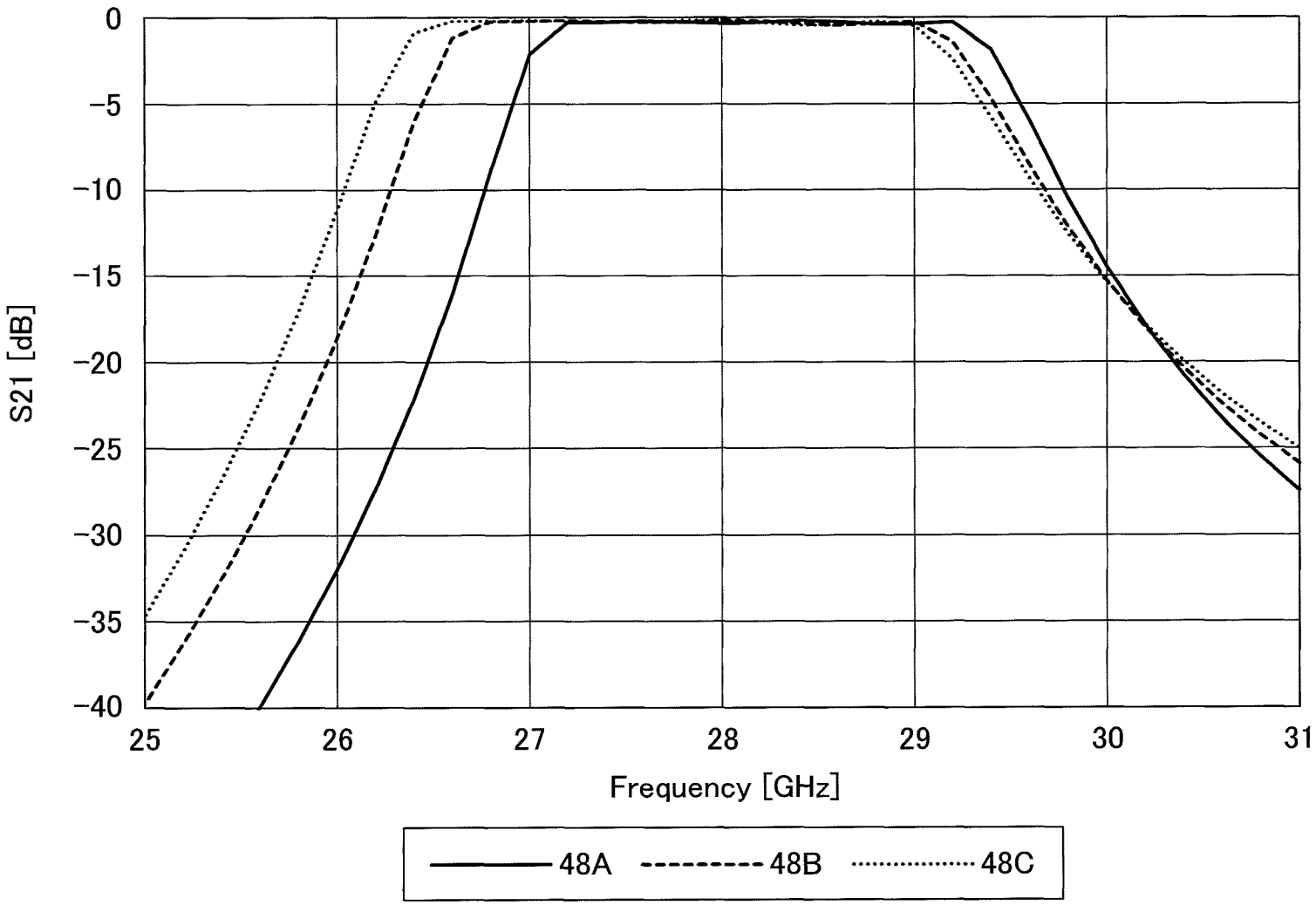
FIG. 18 is a graph illustrating an example of change in the filter characteristic in a case where an end shape of the slit forming the control wall is changed in the filter according to the first embodiment.

FIG. 18 is a drawing illustrating an example of change in the filter characteristic in a case where the end shape of the slit forming the control wall is changed in the filter of the first embodiment. FIG. 18 illustrates the filter characteristic (i.e., transfer characteristic S21 which is one of the S parameters) in a case where the control walls 48A to 48C illustrated in FIGS. to 5, respectively, are applied to the control walls of the filter 10A of FIG. 2. The bandwidth of the transfer characteristic of the filter 10A (i.e., the frequency band in which radio frequency signals can pass through the filter 10A) can be extended to a lower frequency side with the control walls 48B, 48C in which the wall thickness at the end portion is smaller than the wall thickness at the central portion, as compared with the control wall 48A in which the wall thickness at the end portion is the same as the wall thickness at the central portion.

It should be noted that the sizes of the respective portions in FIGS. 2 to 5 during the simulation of FIG. 18 were as follows, in millimeters.

L41: 4.2
L42: 17.75
L43: 1.0
L44: 1.3
L45: 1.35
L46: 1.3
L47: 1.0

Distance in the X axis direction between the left end of the filter 10A and the control wall 47*a* (47*b*): 2.35

Distance in the X axis direction between the control wall 47*a* (47*b*) and the control wall 46*a* (46*b*): 2.8

Distance in the X axis direction between the control wall 46*a* (46*b*) and the control wall 45*a* (45*b*): 3.1

Distance in the X axis direction between the control wall 45*a* (45*b*) and the control wall 44*a* (44*b*): 3.1

Distance in the X axis direction between the control wall 44*a* (44*b*) and the control wall 43*a* (43*b*): 2.8

Distance in the X axis direction between the control wall 43*a* (43*b*) and the right end of the filter 10A: 2.35

W3 (FIGS. 3 to 5): 0.25
L3 (FIGS. 4, 5): 0.125

The sizes of respective portions of the pair of control walls opposing each other in the X axis direction were the same as each other. In the simulation, the Finite Element Method (FEM) was used, and the material of the dielectric 23 was assumed to be silica glass (relative permittivity $\varepsilon r=3.85$, dielectric loss tangent $\tan \delta=0.0005$).

Figure 19:
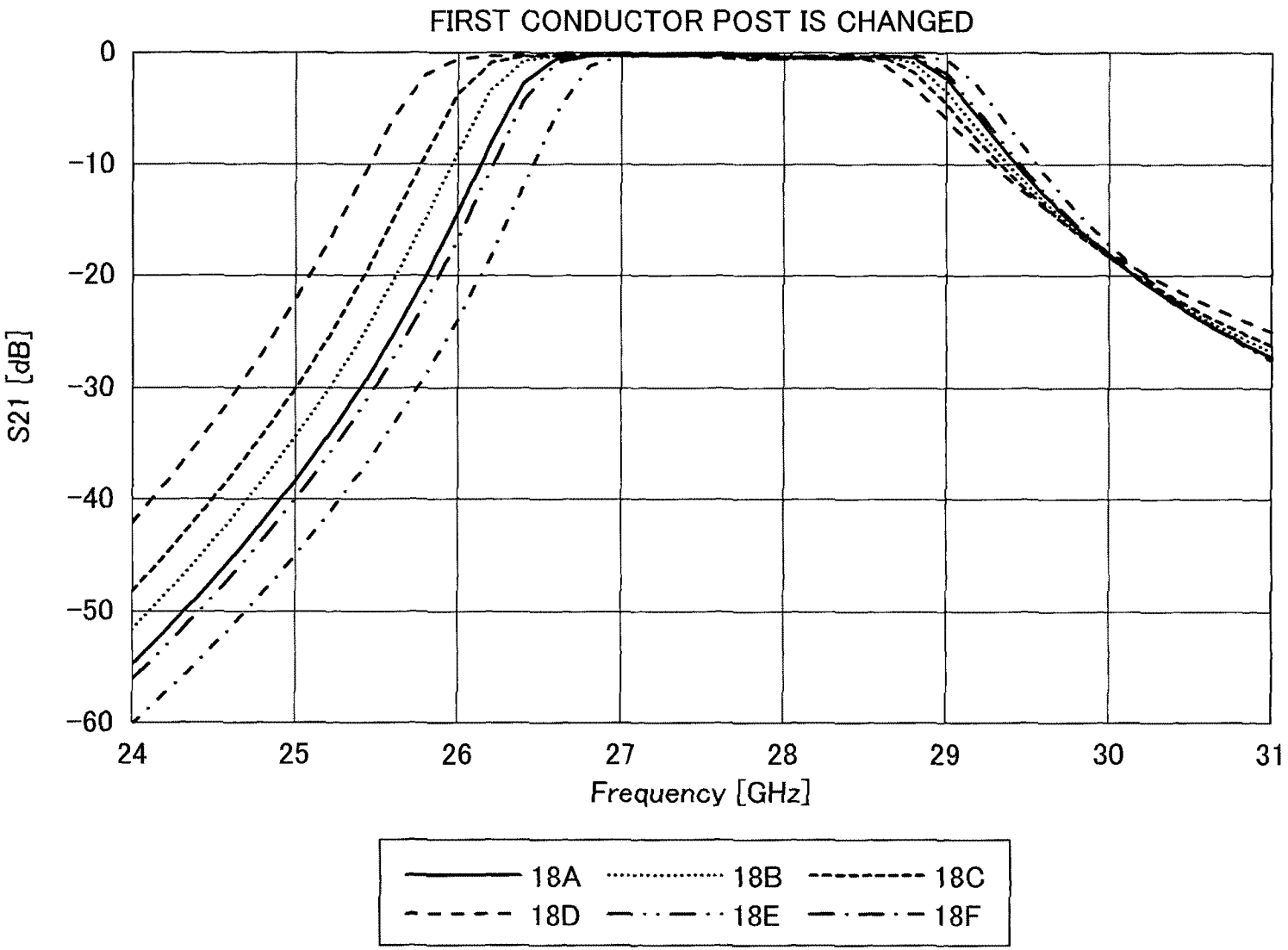
FIG. 19 is a graph illustrating an example of change in the filter characteristic in a case where the shape of the first conductor post from the end of the control wall is changed in the filter according to the second embodiment.

FIG. 19 is a drawing illustrating an example of change in the filter characteristic in a case where the shape of the first conductor post 19*a* from the end of the control wall is changed. FIG. 19 illustrates the filter characteristic (transfer characteristic S21) in a case where the control walls 18A to 18F illustrated in FIGS. 9 to 14, respectively, are applied to the control wall of the filter 10B of FIG. 8. The bandwidth of the transfer characteristic of the filter 10A (i.e., the frequency band in which radio frequency signals can pass through the filter 10A) can be extended to a lower frequency side with the control walls 18B to 18D in which the wall thickness at the end portion is smaller than the wall thickness at the central portion, as compared with the control wall 18A in which the wall thickness at the end portion is the same as the wall thickness at the central portion. Conversely, the bandwidth of the transfer characteristic of the filter 10A (i.e., the frequency band in which radio frequency signals can pass through the filter 10A) can be reduced at the lower frequency side with the control walls 18E, 18F in which the wall thickness at the end portion is larger than the wall thickness at the central portion, as compared with the control wall 18A in which the wall thickness at the end portion is the same as the wall thickness at the central portion.

Figure 20:
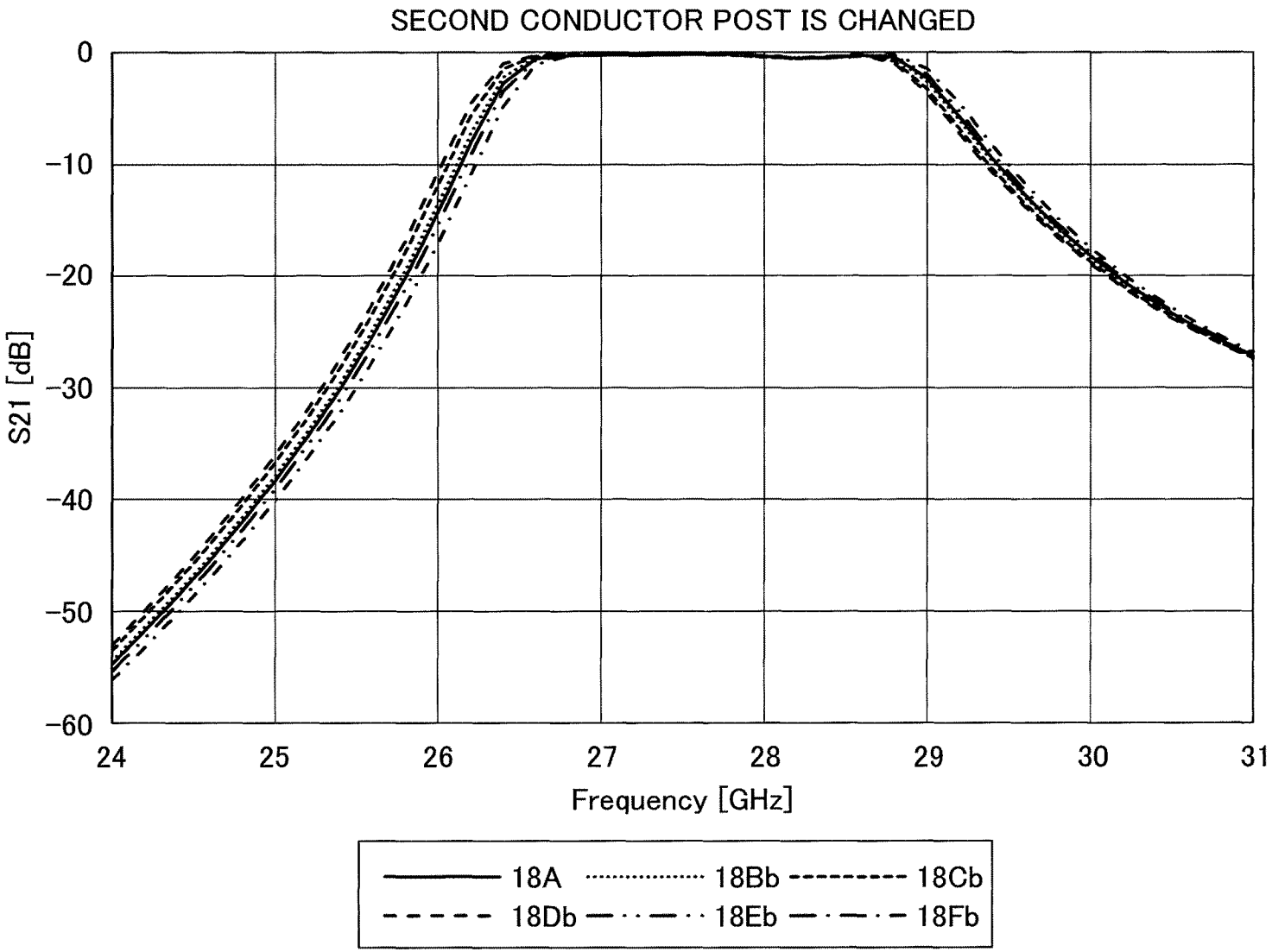
FIG. 20 is a graph illustrating an example of change in the filter characteristic in a case where the shape of the second conductor post from the end of the control wall is changed in the filter according to the second embodiment.

FIG. 20 is a drawing illustrating an example of change in the filter characteristic (transfer characteristic S21) in a case where the shape of the second conductor post 19*b* from the end of the control wall is changed in the filter according to the second embodiment. Specifically, a control wall 18Bb represents a control wall having a configuration in which locations of the conductor posts 19*a* and the conductor posts 19*b* are swapped in the control wall 18B illustrated in FIG. 10. A control wall 18Cb represents a control wall having a configuration in which locations of the conductor post 19*a* and the conductor posts 19*b* are swapped in the control wall 18C illustrated in FIG. 11. A control wall 18Db represents a control wall having a configuration in which locations of the conductor post 19*a* and the conductor posts 19*b* are swapped in the control wall 18D illustrated in FIG. 12. A control wall 18Eb represents a control wall having a configuration in which locations of the conductor posts 19*a* and the conductor posts 19*b* are swapped in the control wall 18E illustrated in FIG. 13. A control wall 18Fb represents a control wall having a configuration in which locations of the conductor posts 19*a* and the conductor posts 19*b* are swapped in the control wall 18F illustrated in FIG. 14.

Figure 21:
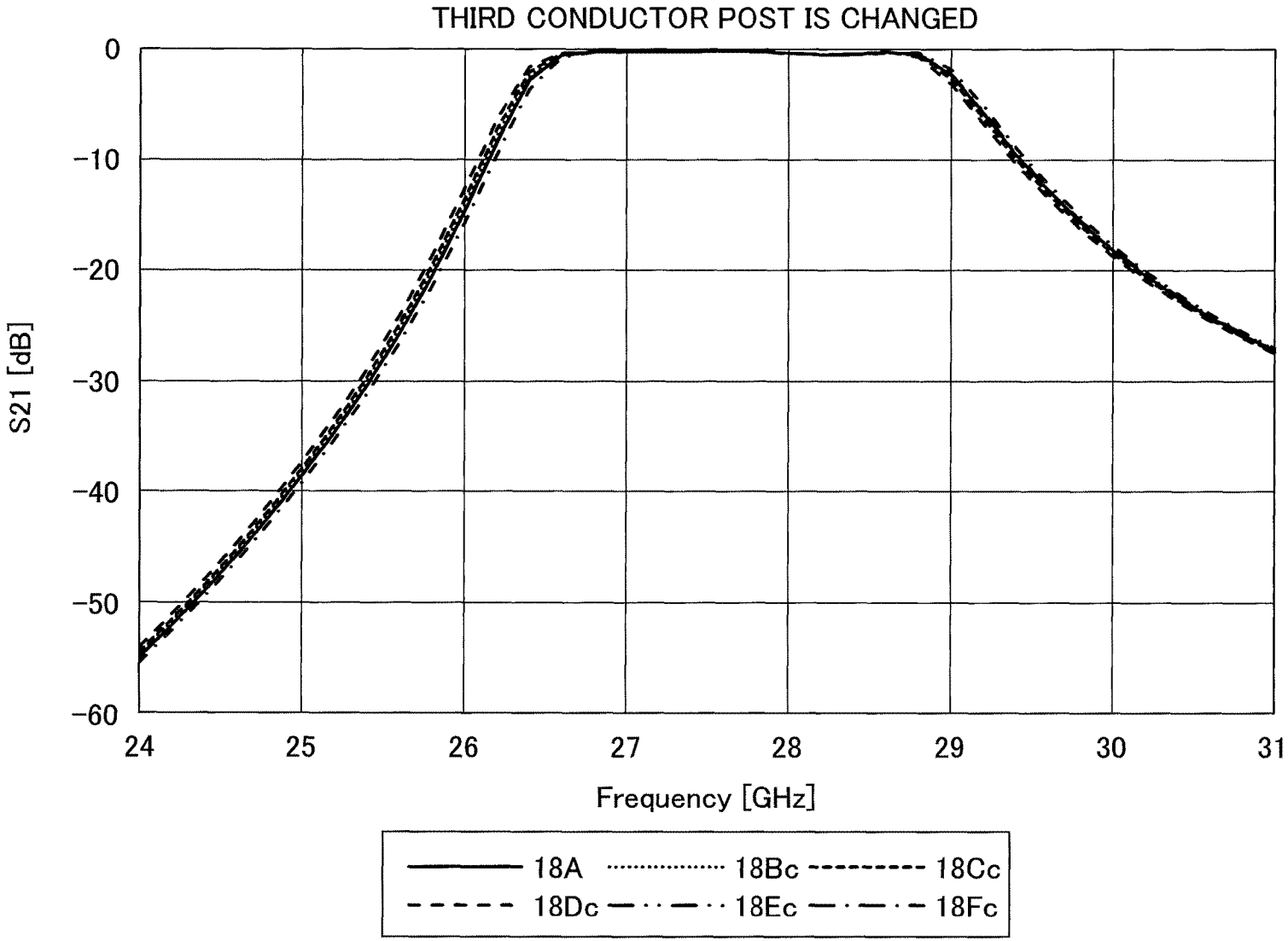
FIG. 21 is a graph illustrating an example of change in the filter characteristic in a case where the shape of the third conductor post from the end of the control wall is changed in the filter according to the second embodiment.

FIG. 21 is a drawing illustrating an example of change in the filter characteristic (transfer characteristic S21) in a case where the shape of the third conductor post 19*c* from the end of the control wall is changed in the filter according to the second embodiment. Like the case described above, controls walls 18Bc, 18Cc, 18Dc, 18Ec, 18Fc are control walls having configurations in which locations of the conductor post(s) 19*a* and the conductor posts 19*c* are swapped in the control walls 18B to 18F illustrated in FIGS. 10 to 14, respectively.

Figure 22:
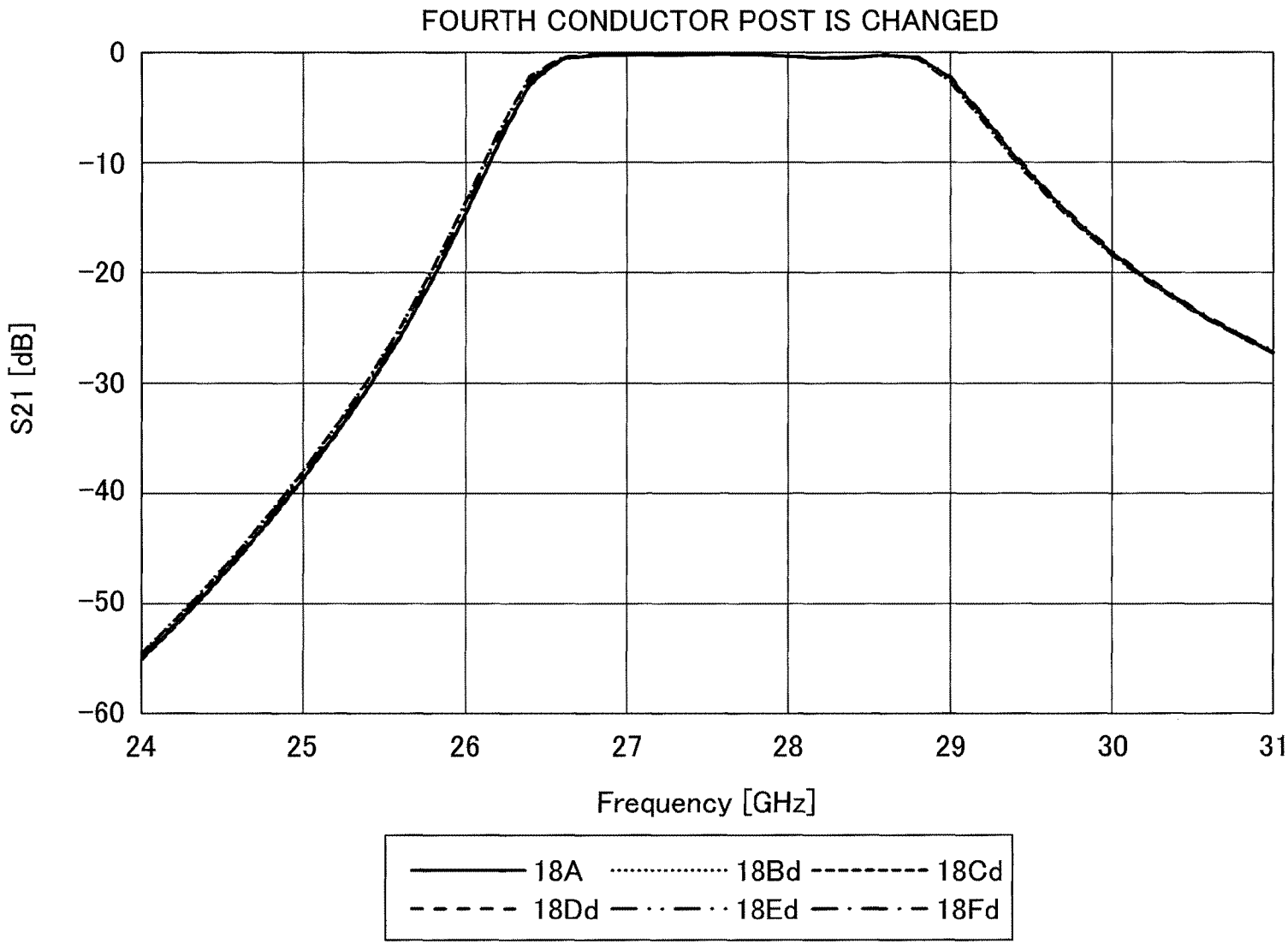
FIG. 22 is a graph illustrating an example of change in the filter characteristic in a case where the shape of the fourth conductor post from the end of the control wall is changed in the filter according to the second embodiment.

FIG. 22 is a drawing illustrating an example of change in the filter characteristic (transfer characteristic S21) in a case where the shape of the fourth conductor post 19*d* from the end of the control wall is changed in the filter according to the second embodiment. Like the case described above, control walls 18Bd, 18Cd, 18Dd, 18Ed, 18Fd are control walls having configurations in which locations of the conductor post(s) 19*a* and the conductor posts 19*d* are swapped in the control walls 18B to 18F illustrated in FIGS. 10 to 14, respectively.

As illustrated in FIGS. 19 to 22, when the wall thickness of the wall portion formed by the conductor posts is changed at the position close to the base portion of the control wall, the transfer characteristic S21 does not appreciably change. In this manner, it has been shown that the filter characteristic can be adjusted to a desired filter characteristic more easily when the wall thicknesses are changed between the end portion and the central portion than when the wall thicknesses are changed between the base portion and the central portion.

It should be noted that the sizes of the respective portions in FIGS. 8 to 14 during the simulation of FIGS. 19 to 22 were as follows, in millimeters.

L13: 0.9
L14: 1.2
L15: 1.25
L16: 1.2
L17: 0.9
L21: 4.8 (The filter characteristic is determined by L24)
L22: 17.75
L24: 4.0

Distance in the X axis direction between the left end of the filter 10B and the control wall 17*a* (17*b*): 2.35

Distance in the X axis direction between the control wall 17*a* (17*b*) and the control wall 16*a* (16*b*): 2.8

Distance in the X axis direction between the control wall 16*a* (16*b*) and the control wall 15*a* (15*b*): 3.1

Distance in the X axis direction between the control wall 15*a* (15*b*) and the control wall 14*a* (14*b*): 3.1

Distance in the X axis direction between the control wall 14*a* (14*b*) and the control wall 13*a* (13*b*): 2.8

Distance in the X axis direction between the control wall 13*a* (13*b*) and the right end of the filter 10B: 2.35

W3 (FIGS. 9 to 14): 0.25
L3 (FIGS. 9 to 14): 0.3
W1 (FIG. 10): 0.231
W1 (FIG. 11): 0.175
W1 (FIG. 12): 0.100
W1 (FIG. 13): 0.412
W1 (FIG. 14): 0.475

The sizes of respective portions of the pair of control walls opposing each other in the X axis direction were the same as each other. In the simulation, the Finite Element Method (FEM) was used, and the material of the dielectric 23 was assumed to be silica glass (relative permittivity $\varepsilon r=3.85$, dielectric loss tangent $\tan \delta=0.0005$).

Although the filter has been described above with reference to the embodiments, the present invention is not limited to the above embodiments. Various modifications and improvements, such as combination or substitution with a part or all of another embodiment, are possible within the scope of the present invention.

For example, the conductor wall may be provided with only one control wall, instead of the multiple control walls.

What is claimed is:

1. A filter, comprising:

a dielectric; and at least one conductor wall surrounding the dielectric such that a waveguide is formed in the dielectric, wherein the at least one conductor wall includes at least one control wall protruding toward an inner side of the waveguide, the at least one control wall includes an end portion in a protruding direction of the at least one control wall and a central portion in the protruding direction, the end portion includes a wall portion having a wall thickness that is different from a wall thickness of the central portion, and has a first wall portion including a tip in the protruding direction and a second wall portion formed between the first wall portion and the central portion such that a wall thickness of the second wall portion is formed different from a wall thickness of the first wall portion, the at least one control wall is formed such that a length of the first wall portion in the protruding direction is shorter than a length of the second wall portion in the protruding direction, and the at least one control wall satisfies that L3/(L2+L3) is less than 0.2, where L3 is the length of the first wall portion in the protruding direction and L2 is the length of the second wall portion in the protruding direction.

2. The filter according to claim 1, wherein the at least one control wall is a plurality of conductor posts forming a fence, such that a wall thickness formed by at least one of the plurality of conductor posts formed at a position farthest from a base portion in the protruding direction of the at least one control wall is different from a wall thickness formed by at least another of the plurality of conductor posts formed at a position closest to the base portion.

3. The filter according to claim 1, wherein the at least one control wall is a plurality of conductor posts forming a fence, such that a wall thickness formed by at least one of the plurality of conductor posts formed at a position second farthest from a base portion in the protruding direction of the at least one control wall is different from a wall thickness formed by at least another one of the plurality of conductor posts formed at a position closest to the base portion.

4. The filter according to claim 1, wherein the at least one control wall is a set of a plurality of conductor posts forming a fence, such that a number of conductor posts of the plurality of conductor posts formed at a position farthest from a base portion in the protruding direction of the at least one control wall is different from a number of conductor posts of the plurality of conductor posts formed at a position closest to the base portion.

5. The filter according to claim 1, wherein the at least one control wall is a plurality of conductor posts forming a fence, such that a diameter of at least one of the plurality of conductor posts formed at a position farthest from a base portion in the protruding direction of the at least one control wall is different from a diameter of at least another of the plurality of conductor posts formed at a position closest to the base portion.

6. The filter according to claim 1, wherein the at least one conductor wall includes a pair of side walls opposing each other, and the at least one control wall includes a plurality of control walls such that the control walls protrude from the side walls constituting the pair, respectively.

7. The filter according to claim 1, wherein the at least one control wall includes a plurality of control walls such that the control walls are formed with intervals in a predetermined direction, and that lengths of the control walls in the protruding direction gradually increase in an order of positions of the plurality of control walls.

8. The filter according to claim 1, wherein the at least one control wall includes a plurality of control walls such that the control walls are formed with intervals in a predetermined direction, and that lengths of the control walls in the protruding direction gradually decrease in an order of positions of the plurality of control walls.

9. The filter according to claim 1, wherein the at least one control wall includes a plurality of conductor posts forming a fence.

10. The filter according to claim 1, wherein the wall thickness at the wall portion of the end portion is smaller than the wall thickness at the central portion.

11. The filter according to claim 10, wherein the at least one control wall is a plurality of conductor posts forming a fence such that a wall thickness formed by at least one of the plurality of conductor posts formed at a position farthest from a base portion in the protruding direction of the at least one control wall is different from a wall thickness formed by at least another of the plurality of conductor posts formed at a position closest to the base portion.

12. The filter according to claim 10, wherein the at least one control wall is a plurality of conductor posts forming a fence such that a wall thickness formed by at least one of the plurality of conductor posts formed at a position second farthest from a base portion in the protruding direction of the at least one control wall is different from a wall thickness formed by at least another one of the plurality of conductor posts formed at a position closest to the base portion.

13. The filter according to claim 10, wherein the at least one control wall is a set of a plurality of conductor posts forming a fence such that a number of conductor posts of the plurality of conductor posts formed at a position farthest from a base portion in the protruding direction of the at least one control wall is different from a number of conductor posts of the plurality of conductor posts formed at a position closest to the base portion.

14. The filter according to claim 10, wherein the at least one conductor wall includes a pair of side walls opposing each other, and the at least one control wall includes a plurality of control walls such that the control walls protrude from the side walls constituting the pair, respectively.

15. The filter according to claim 10, wherein the at least one control wall includes a plurality of control walls such that the control walls are formed with intervals in a predetermined direction, and that lengths of the control walls in the protruding direction gradually increase in an order of positions of the plurality of control walls.

16. The filter according to claim 1, wherein the wall thickness at the wall portion of the end portion is larger than the wall thickness at the central portion.

17. The filter according to claim 16, wherein the at least one control wall is a plurality of conductor posts forming a fence such that a wall thickness formed by at least one of the plurality of conductor posts formed at a position farthest from a base portion in the protruding direction of the at least one control wall is different from a wall thickness formed by at least another of the plurality of conductor posts formed at a position closest to the base portion.

18. The filter according to claim 16, wherein the at least one control wall is a plurality of conductor posts forming a fence such that a wall thickness formed by at least one of the plurality of conductor posts formed at a position second farthest from a base portion in the protruding direction of the at least one control wall is different from a wall thickness formed by at least another one of the plurality of conductor posts formed at a position closest to the base portion.

19. The filter according to claim 16, wherein the at least one control wall is a set of a plurality of conductor posts forming a fence such that a number of conductor posts of the plurality of conductor posts formed at a position farthest from a base portion in the protruding direction of the at least one control wall is different from a number of conductor posts of the plurality of conductor posts formed at a position closest to the base portion.

20. The filter according to claim 16, wherein the at least one conductor wall includes a pair of side walls opposing each other, and the at least one control wall includes a plurality of control walls such that the control walls protrude from the side walls constituting the pair, respectively.

* * * * *